US008082695B2

(12) United States Patent
Lin

(10) Patent No.: US 8,082,695 B2
(45) Date of Patent: Dec. 27, 2011

(54) MULLION ASSEMBLY FOR DOUBLE DOOR

(75) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 278 days.

(21) Appl. No.: 12/610,427

(22) Filed: Nov. 2, 2009

(65) Prior Publication Data

US 2011/0099925 A1 May 5, 2011

(51) Int. Cl.
*E06B 5/00* (2006.01)

(52) U.S. Cl. ..... 49/365

(58) Field of Classification Search ..... 49/1, 7, 49/365, 394, 395; 52/204.1, 206
See application file for complete search history.

(56) References Cited

U.S. PATENT DOCUMENTS 5,435,102 A * 7/1995 McCarthy ..... 49/365
5,450,697 A * 9/1995 Prucinsky et al. ..... 52/210
5,471,792 A * 12/1995 Higgins et al. ..... 49/365
5,765,309 A * 6/1998 Mamchych ..... 49/365
5,794,382 A 8/1998 Prucinsky ..... 49/365
5,890,319 A * 4/1999 Haeck et al. ..... 49/365
5,941,023 A * 8/1999 Mamchych ..... 49/365
6,131,338 A * 10/2000 Haeck et al. ..... 49/365
6,427,387 B1 * 8/2002 Hunt ..... 49/365
7,000,355 B2 * 2/2006 Flory et al. ..... 49/365
7,905,058 B2 * 3/2011 Massey et al. ..... 49/365

* cited by examiner

*Primary Examiner* — Jerry Redman
(74) *Attorney, Agent, or Firm* — Alan Kamrath; Kamrath IP Lawfirm, PA

(57) ABSTRACT

A mullion assembly (10) includes a top mounting block (92) having a positioning rod (102) and attached to a top beam (24) of a door frame (22). A bottom mounting block (112) is mounted on a floor (20) spaced from the top beam (24) in a vertical direction. A post (40) is detachably mounted between top and bottom mounting blocks (92, 112). A brace (50) is mounted to an upper end (42) of the post (40). A mounting bracket (122) is mounted to the brace (50). A pivotal plate (172) is pivotably mounted to the mounting bracket (122) and detachably engaged with the positioning rod (102). A retaining member (138) is mounted to the mounting bracket (122) to lock the post (40) between the top and bottom mounting blocks (92, 112). The mounting bracket (122) moves upwardly and is coupled with the positioning rod (102), allowing further locking of the post (40) when the mullion assembly (10) is exposed to a fire.

10 Claims, 14 Drawing Sheets

MULLION ASSEMBLY FOR DOUBLE DOOR

BACKGROUND OF THE INVENTION

The present invention relates to a mullion assembly and, more particularly, to a mullion assembly for a double door mounted in a double doorway.

It is usual to mount a mullion assembly in a double doorway for engaging with two latches of two doors (or known as a double door) pivotably mounted on opposite sides of a door frame. Easy removal of the mullion assembly is required when a full door opening is desired for unobstructed pass purposes. Furthermore, to prevent the doors from being opened when exposed to a fire, it is desirable for the mullion assembly to have enhanced structural strength and fire resistant functions. In a proposed design, the mullion assembly includes a top fitting mounted to the top of a door frame, a bottom fitting assembly mounted to the bottom of the door frame, a mullion head detachably engaged with the top fitting, and a mullion tube mounted between the mullion head and the bottom fitting assembly. A fusible spacer is disposed between the top fitting and the mullion head for accommodating thermal expansion of the mullion assembly in case of fire to resist warping of the mullion assembly. The top fitting includes a vertical slot into which a locking bolt extends. The locking bolt moves upwardly in the vertical slot due to thermal expansion of the mullion assembly to maintain the locked condition without buckling the mullion assembly when the fusible spacer melts due to the heat of the fire. However, a high pressure gas could be generated due to high temperature of combustion or explosion in the fire to destroy the mullion assembly. This is because the engaging force between the mullion tube and the top fitting depends only on the locking bolt and is, thus, insufficient to withstand the high pressure gas, resulting in undesired opening of the doors and flowing of smoke and fire from the outside into the inside.

Thus, a need exists for a mullion assembly with a removable post that allows easy assembly while having improved structural strength to withstand fire.

BRIEF SUMMARY OF THE INVENTION

The present invention solves this need and other problems in the field of mullion assemblies for a double door mounted in a double doorway by providing, in a preferred form, a mullion assembly including a top mounting block adapted to be attached to a top beam of a door frame that includes two opposite side beams to which two doors of the double door are pivotably mounted. Each door includes a door lock having a latch. The top mounting block includes a positioning rod extending in a horizontal direction. The mullion assembly further includes a bottom mounting block adapted to be mounted on a floor spaced from the top beam in a vertical direction. The bottom mounting block is aligned with the top mounting block in the vertical direction. The mullion assembly further includes a post having two strikes adapted to respectively couple with the latches of the door locks when the doors are in a closed state. The post includes upper and lower ends spaced in the vertical direction. The lower end of the post is detachably engaged with the bottom mounting block. A brace is mounted to the upper end of the post. A mounting bracket is mounted to the brace. A pivotal plate is pivotably mounted to the mounting bracket and includes upper and lower ends spaced in the vertical direction. The pivotal plate further includes a coupling slot in the upper end of the pivotal plate such that the positioning rod is removably received in the coupling slot of the pivotal plate. The upper end of the pivotal plate is rotatable relative to the mounting bracket between a first position and a second position. A retaining member is moveably mounted to the mounting bracket and includes a locking portion and an engaging portion. The locking portion of the retaining member is moveable between a locking position engaged with the pivotal plate and an unlocking position disengaged from the pivotal plate. A key cylinder is mounted to the brace and includes a key-operable actuating member. The actuating member is operably connected to the engaging portion of the retaining member to move the retaining member between the locking position and the unlocking position. When the upper end of the pivotal plate is in the first position and the locking portion of the retaining member is in the locking position, the pivotal plate can not be rotated relative to the mounting bracket from the first position to the second position, locking the post between the top and bottom mounting blocks. When the upper end of the pivotal plate is in the first position and the locking portion of the retaining member is in the unlocking position, the pivotal plate can be rotated relative to the mounting bracket from the first position to the second position, allowing removal of the post from the top and bottom mounting blocks.

In the most preferred form, the mounting bracket is substantially U-shaped in cross section and includes a main wall and two sidewalls interconnected by the main wall. The two sidewalls of the mounting bracket are spaced in the horizontal direction and each includes upper and lower ends spaced in the vertical direction. The upper end of each sidewall of the mounting bracket has a coupling opening aligned with and below the positioning rod of the top mounting block in the vertical direction. The coupling openings of the mounting bracket are coupled with the positioning rod of the top mounting block when the mounting bracket moves upwardly in the vertical direction due to thermal expansion of the post.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
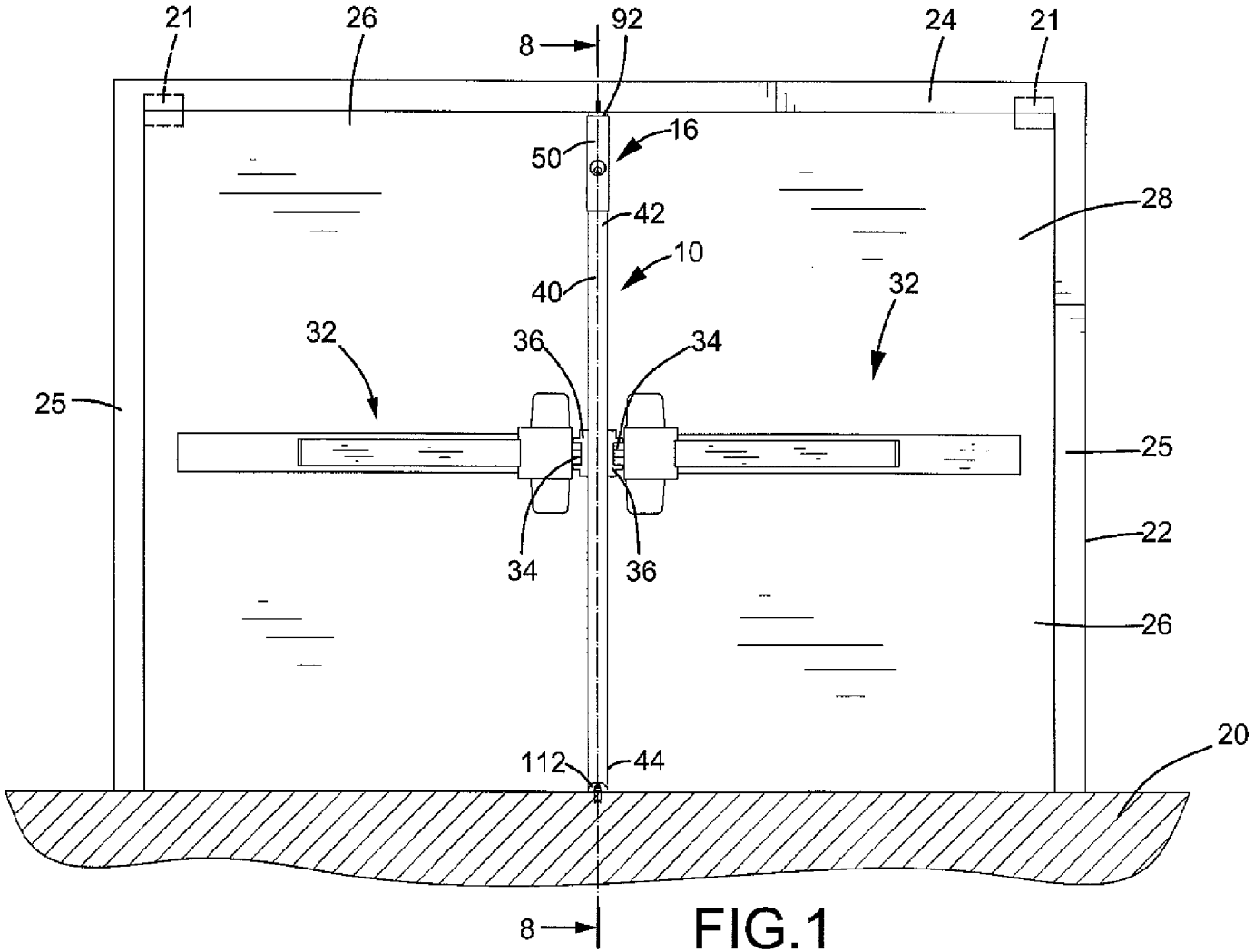
FIG. 1 shows a schematic front view of a mullion assembly according to the preferred teachings of the present invention and a double door to which the mullion assembly is mounted.
Figure 2:
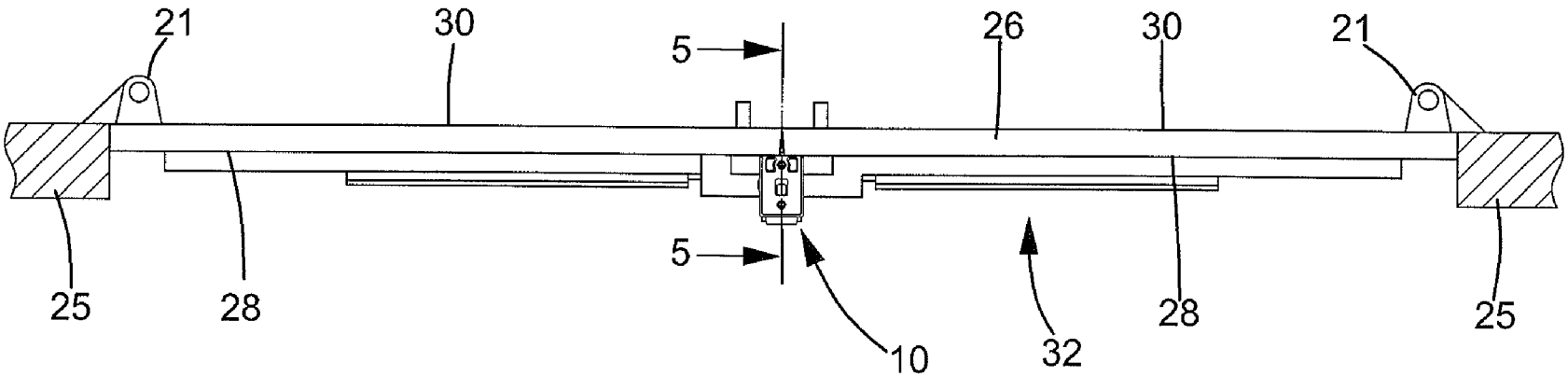
FIG. 2 is a top view of the mullion assembly and the double door of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "top", "bottom", "annular", "vertical" "horizontal", "width", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A mullion assembly according to the preferred teachings of the present invention is shown in the drawings and generally designated 10. According to the most preferred form shown, mullion assembly 10 is mounted in a door frame 22 for a double door mounted in a double doorway. Door frame 22 includes a top beam 24 spaced from a floor 20 in a vertical direction. Door frame 22 further includes two opposite side beams 25 interconnected by top beam 24 and spaced in a horizontal direction perpendicular to the vertical direction. The double door includes inner and outer faces 28 and 30 and first and second doors 26 respectively and pivotably mounted by pivots 21 to side beams 25 of door frame 22 and each including a door lock 32 having a latch 34 on an end thereof.

Figure 14:
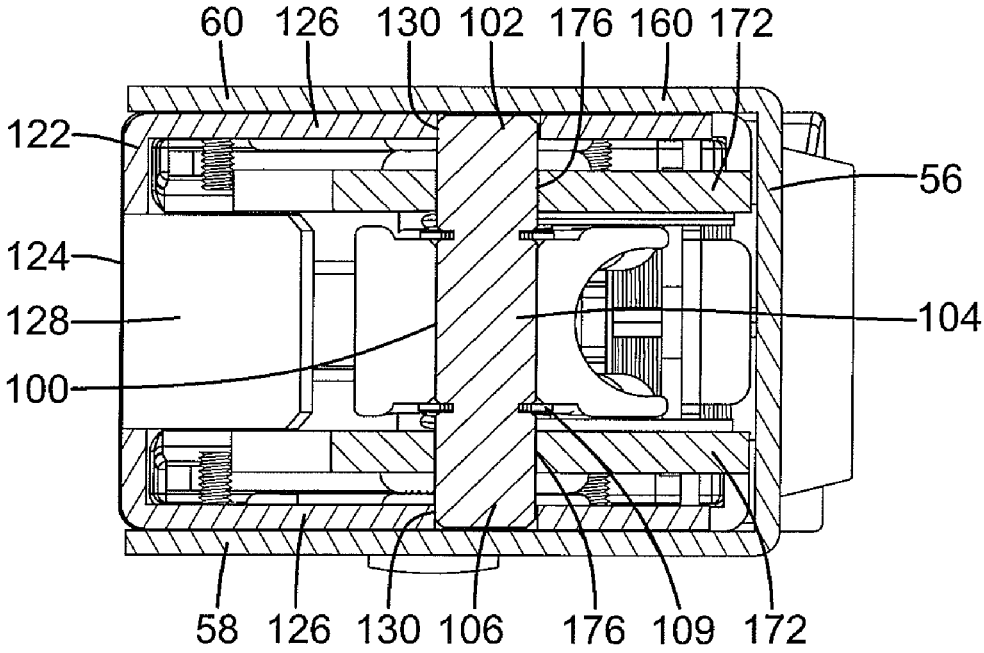
FIG. 14 shows a cross sectional view of the mullion assembly of FIG. 1 taken along section line 14-14 of FIG. 13.

According to the preferred form shown, mullion assembly 10 includes a top mounting block 92 having top and bottom portions 94 and 98 spaced in the vertical direction. Top portion 94 includes a locking hole 96 and two slots 97. A screw 110 is extended through each of locking hole 96 and slots 97 to attach top mounting block 92 to top beam 24 of door frame 22 (see FIG. 8). Bottom portion 98 of top mounting block 92 includes a rod hole 100 extending through bottom portion 98 in the horizontal direction. A positioning rod 102 extends through rod hole 100 in the horizontal direction and includes two ends 106 spaced in the horizontal direction and located outside of rod hole 100 (see FIG. 14). Positioning rod 102 further includes an intermediate section 104 intermediate ends 106 of positioning rod 102 and received in rod hole 100. Positioning rod 102 further includes two annular grooves 108 each of which is intermediate one of ends 106 and intermediate section 104 of positioning rod 102. A retainer ring 109 such as a C-clip is mounted in each annular groove 108 to retain positioning rod 102 in rod hole 100 of top mounting block 92.

Figure 3:
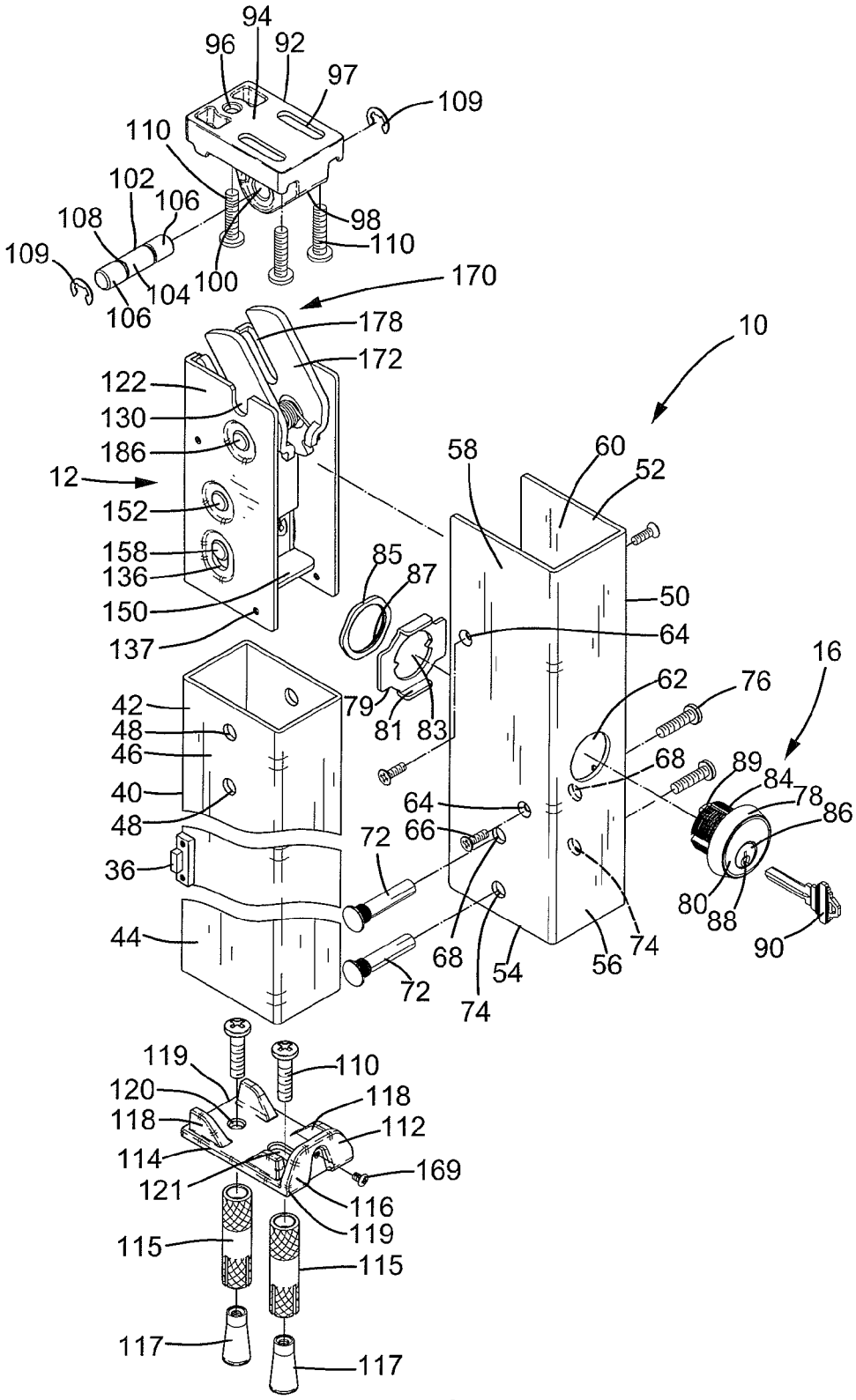
FIG. 3 shows an exploded, perspective view of the mullion assembly of FIG. 1.
Figure 8:
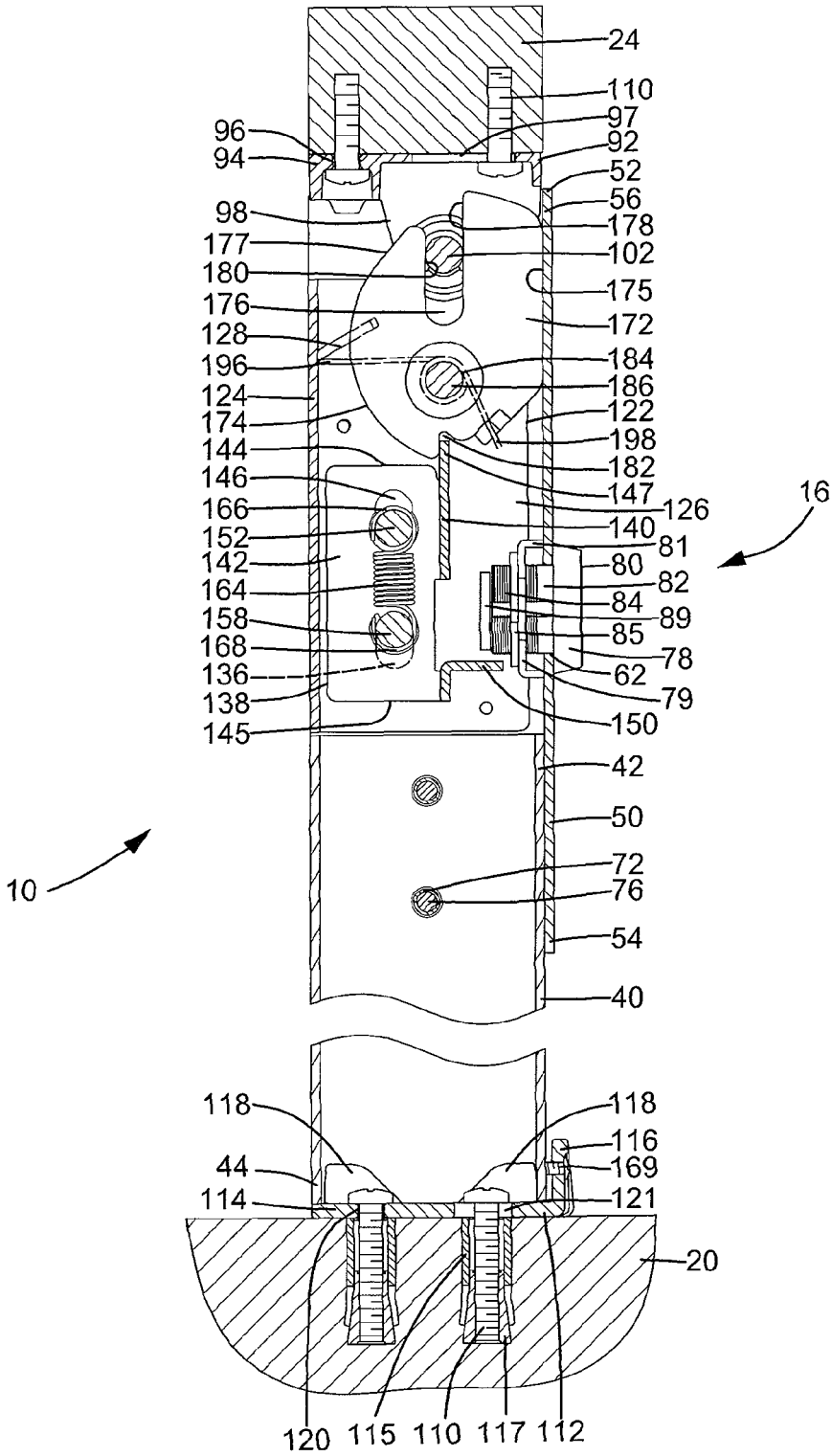
FIG. 8 shows a cross sectional view taken alone section line 8-8 of FIG. 1 and similar to FIG. 7, with a post of the mullion assembly assembled between the top and bottom mounting blocks.

According to the preferred form shown, a bottom mounting block 112 is mounted on floor 20 and aligned with top mounting block 92 in the vertical direction (see FIG. 8). Bottom mounting block 112 includes a base 114 having first and second sides 119 spaced in a width direction perpendicular to the horizontal and vertical directions. A vertical wall 116 extends upward from first side 119 of base 114 in the vertical direction. Two spaced first coupling portions 118 extend upward from second side 119 of base 114 in the vertical direction. Two spaced second coupling portions 118 extend upward from base 114 in the vertical direction and between first coupling portions 118 and vertical wall 116 in the width direction. A screw hole 120 and a slot 121 are provided in and extend through bottom mounting block 112 in the vertical direction. Two sleeves 115 are embedded in floor 20 and respectively aligned with screw hole 120 and slot 121 in bottom mounting block 112 in the vertical direction (see FIGS. 3 and 8). Each sleeve 122 includes a tapered nut 117 therein for receiving a screw 110 which extends through screw hole 120 or slot 121 in bottom mounting block 112. Sleeves 115 are squeezed by tapered nuts 117 and expand to securely engage in floor 20 when screws 110 are threaded into tapered nuts 117 so that bottom mounting block 112 can be attached to floor 20 firmly.

According to the preferred form shown, mullion assembly 10 further includes a post 40 in the most preferred form shown as a hollow tube having rectangular cross sections. Post 40 includes upper and lower ends 42 and 44 spaced in the vertical direction. Post 40 further includes four sidewalls 46 extending between upper and lower ends 42 and 44. Lower end 44 of post 40 is detachably engaged with bottom mounting block 112 with sidewalls 46 of lower end 44 of post 40 mounted around coupling portions 118 of bottom mounting block 112 and resting on base 114 of bottom mounting block 112. Upper end 42 of post 40 includes aligned upper through-holes 48 and aligned lower through-holes 48. Post 40 further includes two strikes 36 respectively coupling with latches 34 of door locks 32 when first and second doors 26 are in a closed state (see FIG. 1).

Figures 6, 6A, 6B:
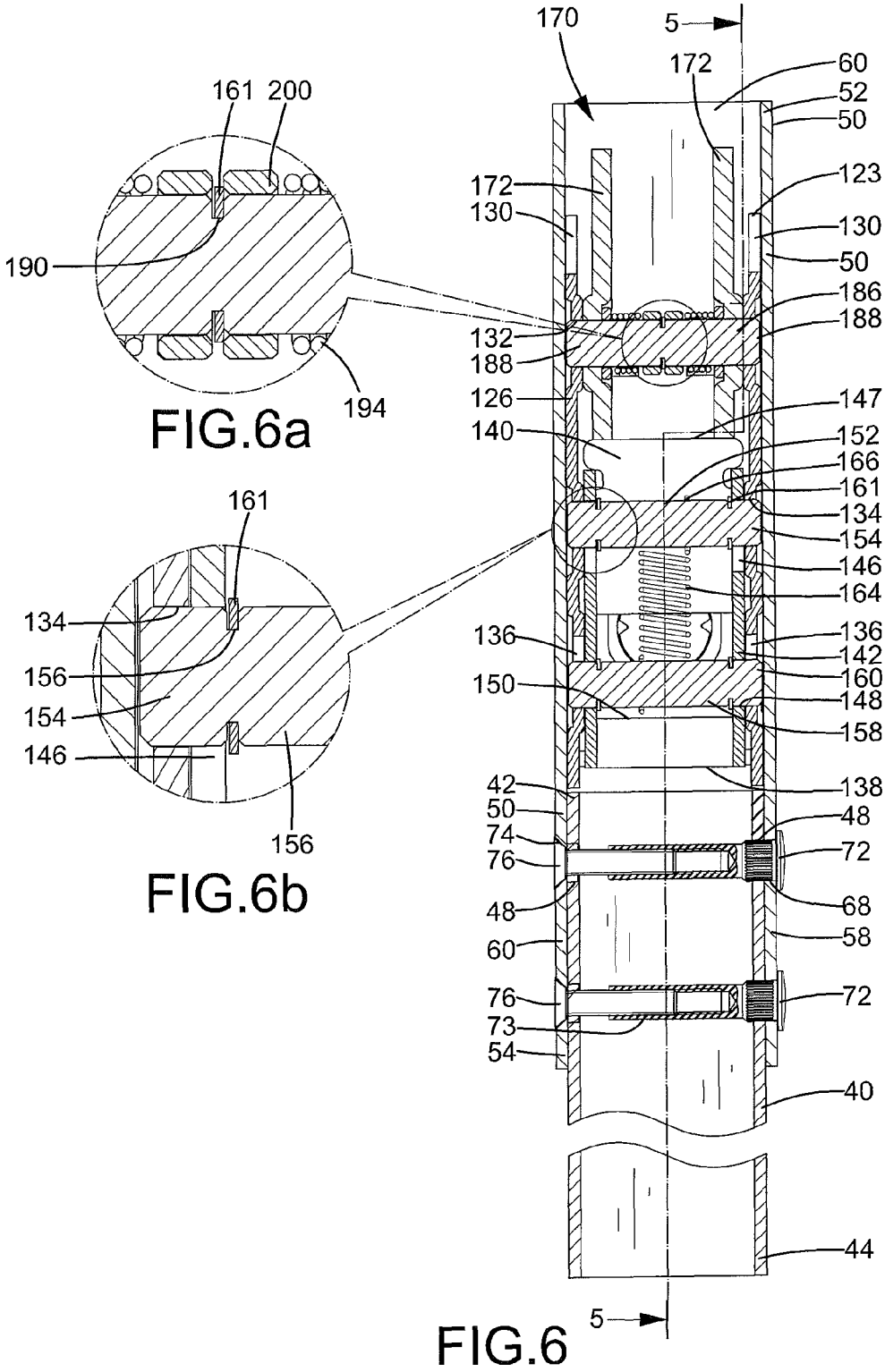
FIG. 6 shows a cross sectional view of the mullion assembly of FIG. 1 taken along section line 6-6 of FIG. 5.
FIG. 6*a* shows an enlarged view of a circled portion of FIG. 6.
FIG. 6*b* shows an enlarged view of another circled portion of FIG. 6.

According to the preferred form shown, mullion assembly 10 further includes a brace 50 that is substantially U-shaped in cross section. Brace 50 includes a first wall 56 and second and third walls 58 and 60 interconnected by first wall 56. Second and third walls 58 and 60 are spaced in the horizontal direction. Brace 50 further includes upper and lower portions 52 and 54 spaced in the vertical direction. Lower portion 54 of each of second and third walls 58 and 60 includes upper and lower through-holes 68 and 74. Upper through-holes 48 of upper end 42 of post 40 are aligned with upper through-holes 68 of second and third walls 58 and 60 of brace 50 in the horizontal direction. An upper pin 72 extends through upper through-hole 68 of second wall 58 and upper through-hole 48 of post 40 and includes a screw hole 73 in an end thereof (see FIG. 6). A lower pin 72 extends through lower through-hole 74 of second wall 58 and lower through-hole 48 of post 40 and includes a screw hole 73 in an end thereof. A screw 76 extends through each of upper and lower through-holes 68 and 74 of third wall 60 of brace 50 and into screw hole 73 of one of upper and lower pins 72 to secure lower portion 54 of brace 50 around upper end 42 of post 40. Further, brace 50 includes a mounting hole 62 in first wall 56, and two fixing holes 64 in each of second and third walls 58 and 60.

Figure 4:
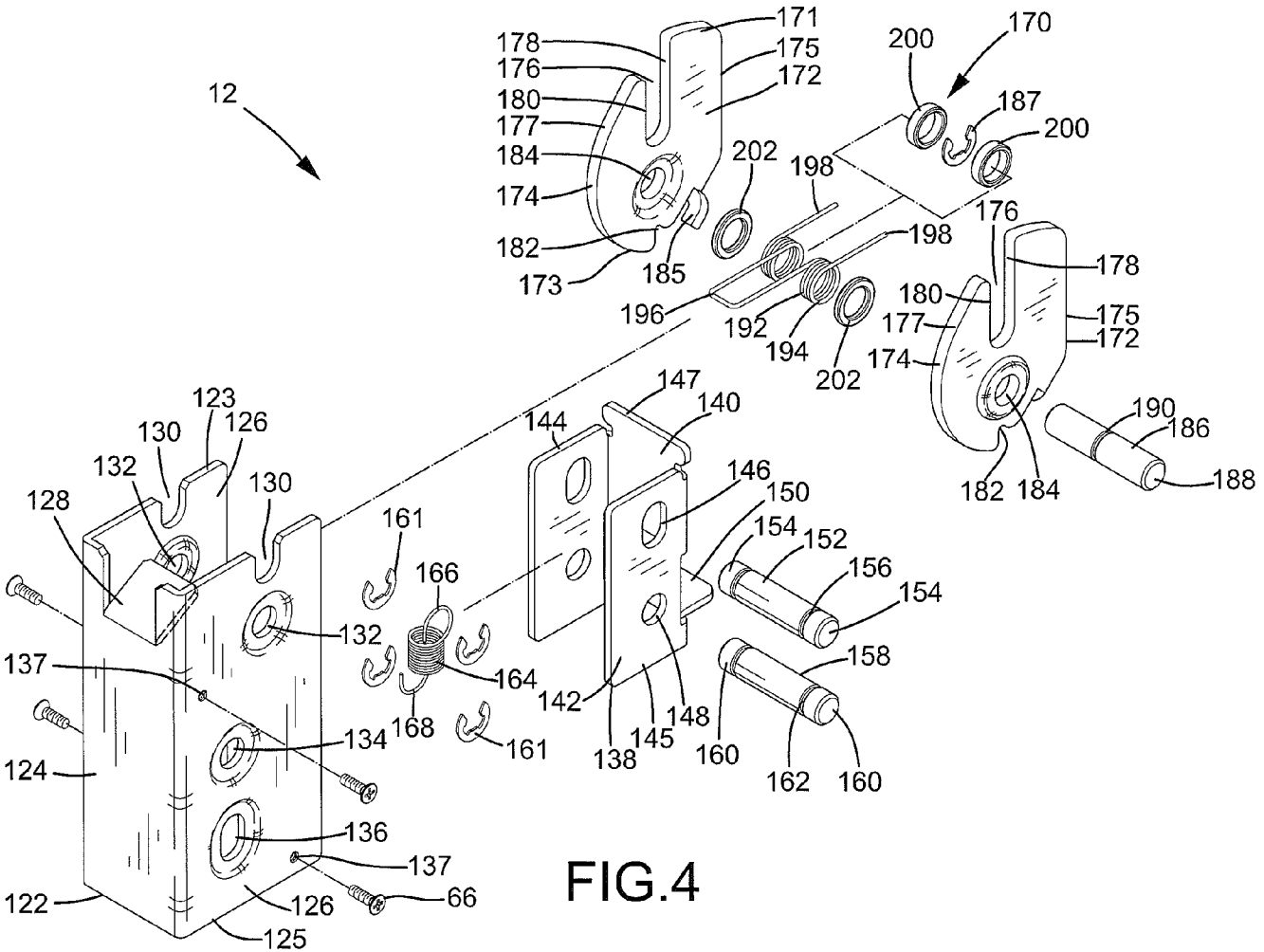
FIG. 4 shows an exploded, perspective view of a positioning device of the mullion assembly of FIG. 1.
Figure 5:
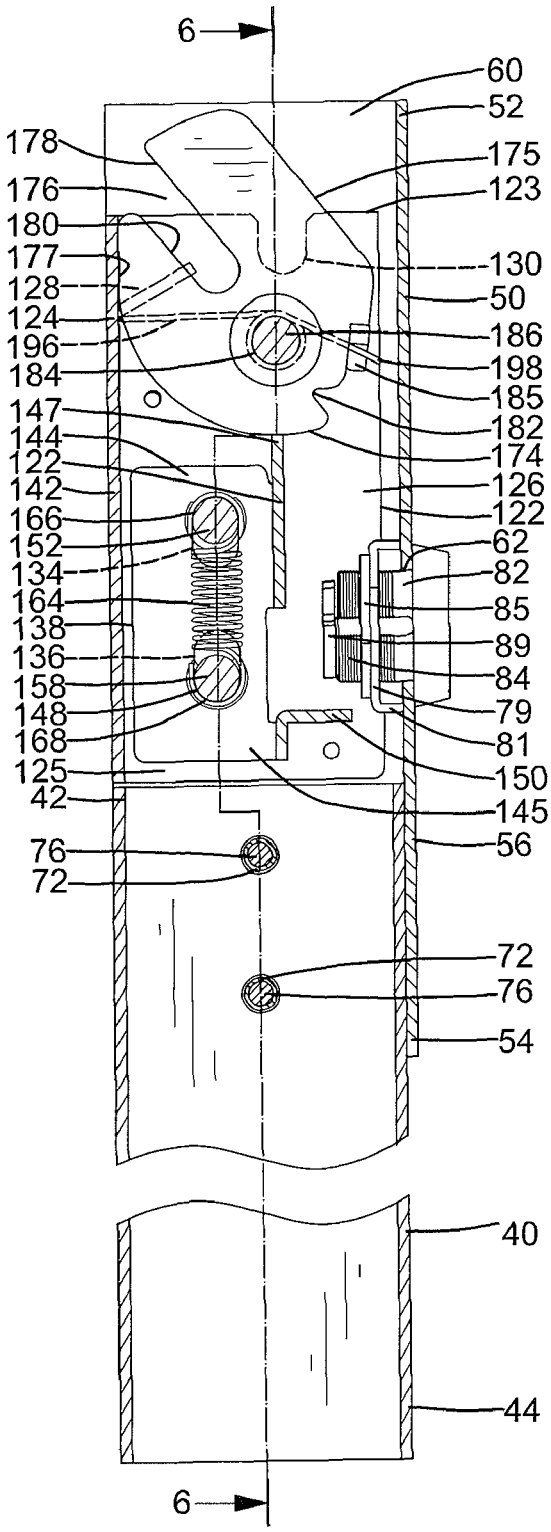
FIG. 5 shows a cross sectional view of the mullion assembly of FIG. 1 taken along section line 5-5 of FIG. 2.

According to the preferred form shown, mullion assembly 10 further includes a positioning device 12 that includes a mounting bracket 122, a coupling assembly 170 and a retaining member 138 (see FIG. 4). Mounting bracket 122 is securely mounted in brace 50. Mounting bracket 122 is substantially U-shaped in cross section and includes a main wall 124 and two sidewalls 126 interconnected by main wall 124 and spaced in the horizontal direction. Each sidewall 126 of mounting bracket 122 includes upper and lower ends 123 and 125 spaced in the vertical direction. Upper end 123 of each sidewall 126 has a coupling opening 130 aligned with and below positioning rod 102 of top mounting block 92 in the vertical direction. Sidewalls 126 of mounting bracket 122 further include aligned shaft holes 132 adjacent to coupling opening 130. Sidewalls 126 of mounting bracket 122 further include aligned sliding slots 136 in lower end 125 of mounting bracket 122 and aligned limiting holes 134. Each limiting hole 134 is intermediate one of shaft holes 132 and one of sliding slots 136 in the vertical direction. An abutting bend 128 is formed on an upper end of main wall 124. Two spaced screw holes 137 are provided in each sidewall 126 of mounting bracket 122 so that mounting bracket 122 can be securely fixed in brace 50 by extending screws 66 through fixing holes 64 in second and third walls 58 and 60 of brace 50 and into screw holes 137 of sidewalls 126 of mounting bracket 122.

According to the preferred form shown, coupling assembly 170 includes two pivotal plates 172 pivotably mounted in mounting bracket 122 and spaced in the horizontal direction. Each pivotal plate 172 includes upper and lower ends 171 and 173 spaced in the vertical direction. A coupling slot 176 is formed in upper end 171 of each pivotal plate 172 and includes opposite first and second sides 178 and 180. Coupling slot 176 has a length in the vertical direction greater than a diameter of positioning rod 102. Each pivotal plate 172 further includes an engaging hole 184 aligned with shaft holes 132 of mounting bracket 122. A shaft 186 extends through shaft holes 132 of mounting bracket 122 and engaging holes 184 of pivotal plates 172 to allow pivotal plates 172 to rotate about a pivot axis defined by shaft 186 between a first position and a second position. Coupling slot 176 of each pivotal plate 172 is at an acute angle to the vertical direction when pivotal plates 172 are in the second position. Coupling slot 176 of each pivotal plate 172 substantially extends in the vertical direction when pivotal plates 172 are in the first position. Each pivotal plate 172 further includes an outer periphery 174 having first and second abutting faces 175 and 177 between which coupling slot 176 is formed. Second abutting face 177 of each pivotal plate 172 is adjacent to main wall 124 of mounting bracket 122 and abuts main wall 124 of mounting bracket 122 when pivotal plates 172 are in the second position. Lower end 173 of each pivotal plate 172 includes a notch 182 and an abutting portion 185. Coupling assembly 170 further includes a torsion spring 192 mounted between pivotal plates 172 and biasing pivotal plates 172 from the first position to the second position. Torsion spring 192 includes two coil portions 194 through which shaft 186 extending and an interconnecting portion 196 interconnecting coil portions 194. Torsion spring 192 further includes first and second tangs 198 each extending from an end of one of coil portions 194. First tang 198 of torsion spring 192 abuts against abutting bend 128 of mounting bracket 122, and second tang 198 of torsion spring 192 abuts against abutting portions 185 of pivotal plates 172. Two spacers 200 are mounted around shaft 186 and between coil portions 194 of torsion spring 192. A washer 202 is mounted around shaft 186 and between one of pivotal plates 172 and one of spacers 200. Shaft 186 includes an annular groove 190 intermediate two ends 188 of shaft 186. A retainer ring 187 such as a C-clip is mounted in annular groove 190 and sandwiched between spacers 200 to retain shaft 186 in place According to the preferred form shown, retaining member 138 is moveably mounted in mounting bracket 122 in the vertical direction and located below pivotal plates 172. Retaining member 138 is substantially U-shaped in cross section and includes an interconnecting plate 140 and two side plates 142 interconnected by the interconnecting plate 140 and spaced in the horizontal direction. Retaining member 138 further includes upper and lower portion 144 and 145 spaced in the vertical direction. Interconnecting plate 140 of retaining member 138 includes upper and lower ends spaced in the vertical direction. A locking portion 147 is formed on the upper end of interconnecting plate 140 of retaining member 138. An engaging portion 150 extends from the lower end of interconnecting plate 140 of retaining member 138 away from side plates 142 of retaining member 138 in the width direction. Side plates 142 of retaining member 138 include aligned limiting slots 146 aligned with limiting holes 134 of mounting bracket 122. Side plates 142 of retaining member 138 further include aligned positioning holes 148 aligned with sliding slots 136 of mounting bracket 122. A first limiting pin 152 extends through limiting holes 134 of mounting bracket 122 and limiting slots 146 of retaining member 138. A second limiting pin 158 extends through sliding slots 136 of mounting bracket 122 and positioning holes 148 of retaining member 138. First limiting pin 152 is located between shaft 186 and second limiting pin 158 in the vertical direction. Each sliding slot 136 of mounting bracket 122 has a length in the vertical direction greater than a diameter of positioning hole 148 of retaining member 138, and each limiting slot 146 of retaining member 138 has a length in the vertical direction greater than a diameter of limiting hole 134 of mounting bracket 122, allowing joint movement of retaining member 138 and second limiting pin 158 relative to mounting bracket 122 in the vertical direction. Thus, locking portion 147 of retaining member 138 is moveable in the vertical direction between a locking position engaged with notches 182 of pivotal plates 172 and an unlocking position disengaged from notches 182 of pivotal plates 172. Retaining member 138 further includes a spring 164 having a first end 166 attached to first limiting pin 152 and a second end 168 attached to second limiting pin 158 to bias retaining member 138 toward pivotal plates 172 and to bias locking portion 147 of retaining member 138 from the unlocking position to the locking position. Further, each of first and second limiting pins 152 and 158 includes two annual grooves 156, 162 in two outer ends 154, 160 thereof. A retainer ring 161 such as a C-clip is mounted in one of annual grooves 156, 162, preventing displacement of first and second limiting pins 152 and 158 in the horizontal direction.

According to the preferred form shown, mullion assembly 10 further includes a key cylinder 16 that includes a hollow body 78 having a flange 80 and receiving a lock core 86 which includes a keyway 88. Outer threading 84 is formed on an outer circumference of hollow body 78, allowing key cylinder 16 to be threadedly coupled in mounting hole 62 of first wall 56 of brace 50 with flange 80 abutting first wall 56 of brace 50. A support plate 79 with a mounting hole 83 and a locking ring 85 with a screw hole 87 are received in brace 50 and mounted around hollow body 78 to secure key cylinder 16 in place.

Support plate 79 includes two bends 81 spaced in the vertical direction and abutting first wall 56 of brace 50. Support plate 79 further includes two sides spaced in the horizontal direction and abutting second and third walls 58 and 60 of brace 50. An actuating member 89 is mounted on an inner end of lock core 86 and rotatable by operation of a key 90 inserted into keyway 88 so that actuating member 89 is operably connected to engaging portion 150 of retaining member 138 to move locking portion 147 of retaining member 138 between the locking and unlocking positions.

Figure 7:
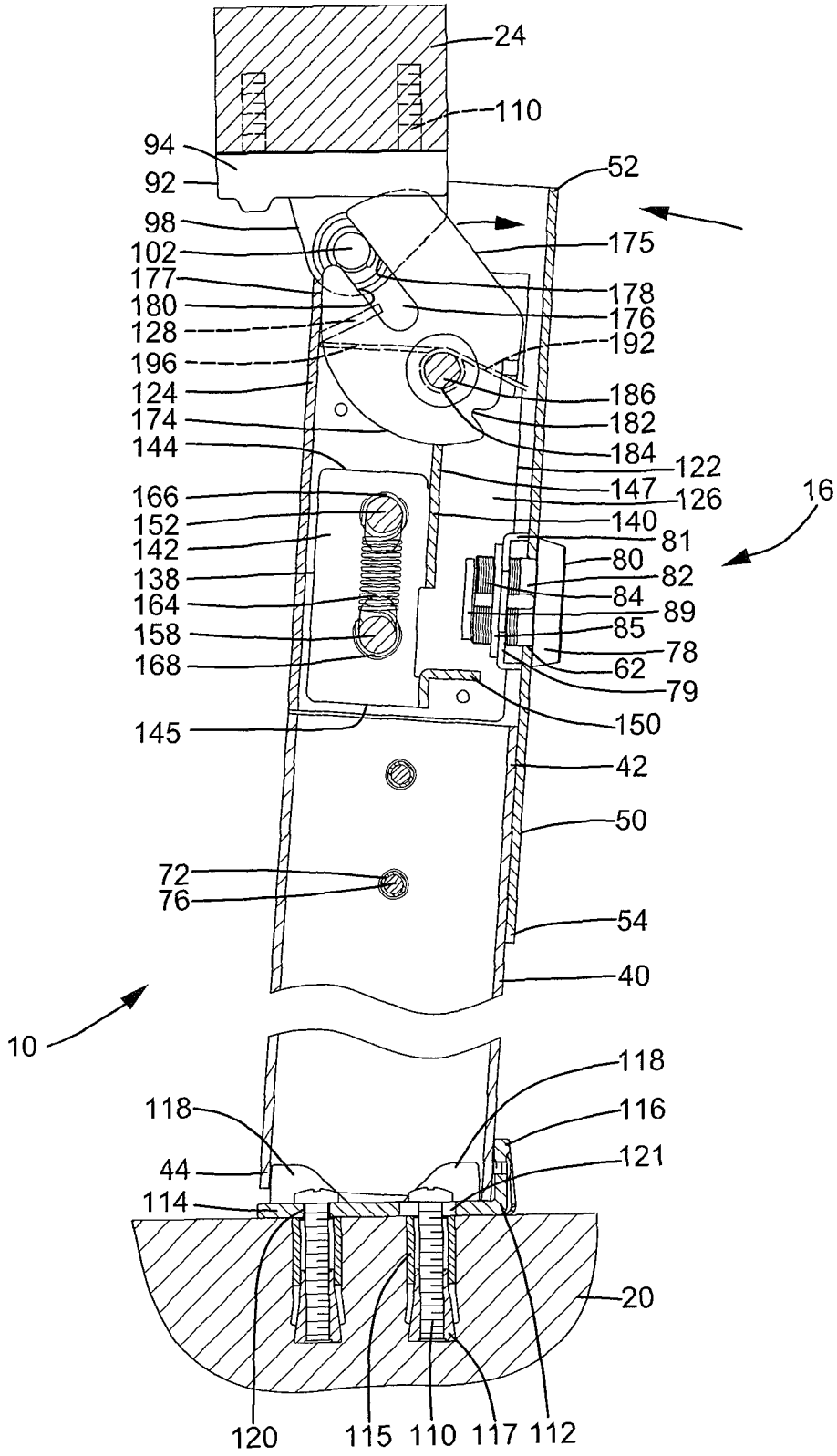
FIG. 7 is a cross sectional view taken along section line 8-8 of FIG. 1, illustrating mounting of the mullion assembly of FIG. 1 to a door frame of the double door.

FIG. 7 illustrates mounting of mullion assembly 10 to door frame 22 in the double doorway. Firstly, top and bottom mounting blocks 92 and 112 are respectively attached to top beam 24 of door frame 22 and floor 20. Next, post 40 with brace 50 fixed thereto is held at an acute angle to floor 20, with lower end 44 of post 40 engaged around coupling portions 118 of bottom mounting block 112 and resting on base 114 of bottom mounting block 112, with upper portions 52 of second and third walls 58 and 60 of brace 50 receiving a portion of top mounting block 92, with locking portion 147 of retaining member 138 abutting against outer periphery 174 of pivotal plates 172, and with positioning rod 102 received in coupling slots 176 of pivotal plates 172. Post 40 is then moved in the horizontal direction and pivoted toward a vertical position at about 90 degrees to floor 20, with ends 106 of positioning rod 102 pressing against first side 178 of coupling slot 176, and with pivotal plates 172 being moved from the second position to the first position and compressing torsion spring 192. When post 40 reaches the vertical position (see FIG. 8), lower end 44 of post 40 is fittingly engaged around coupling portions 118 of bottom mounting block 112, and positioning rod 102 is entirely received in coupling slots 176 of pivotal plates 172. Furthermore, when pivotal plates 172 move to the first position, first abutting faces 175 of pivotal plates 172 abut against first wall 56 of brace 50, and locking portion 147 of retaining member 138 moves upward in the vertical direction to the locking position engaged with notches 182 of pivotal plates 172 under the action of spring 164, allowing post 40 to be locked between top and bottom mounting blocks 92 and 112. Further, a screw 169 can be extended through vertical wall 116 of bottom mounting block 112 and presses against a portion of lower end 44 of post 40 between vertical wall 116 and second coupling portions 118 of bottom mounting block 112 to provide post 40 with an enhanced positioning effect.

Figure 9:
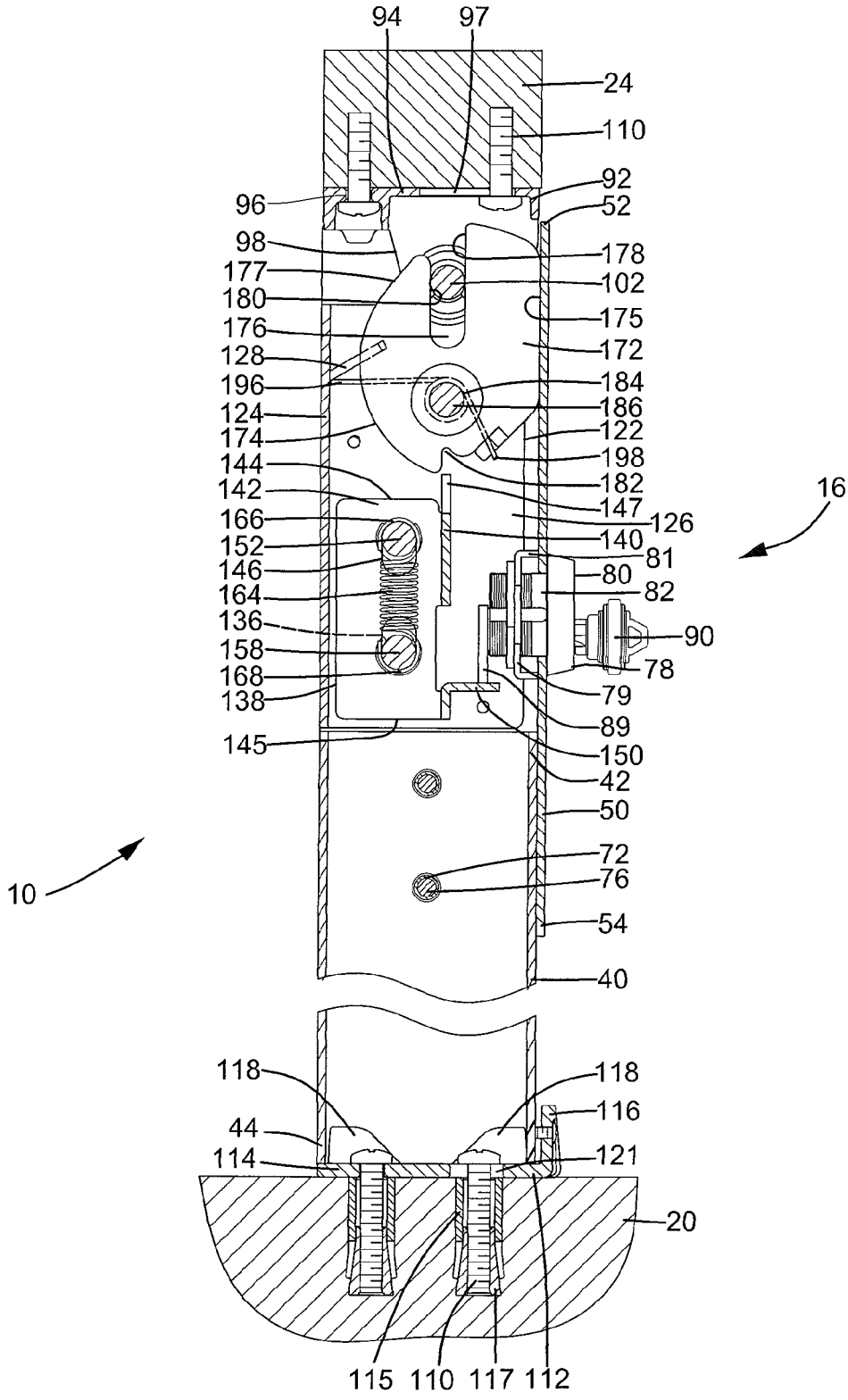
FIG. 9 shows a cross sectional view taken along section line 8-8 of FIG. 1 and similar to FIG. 8, with a retaining member moved downward through activation of a key-operable actuating member.
Figure 10:
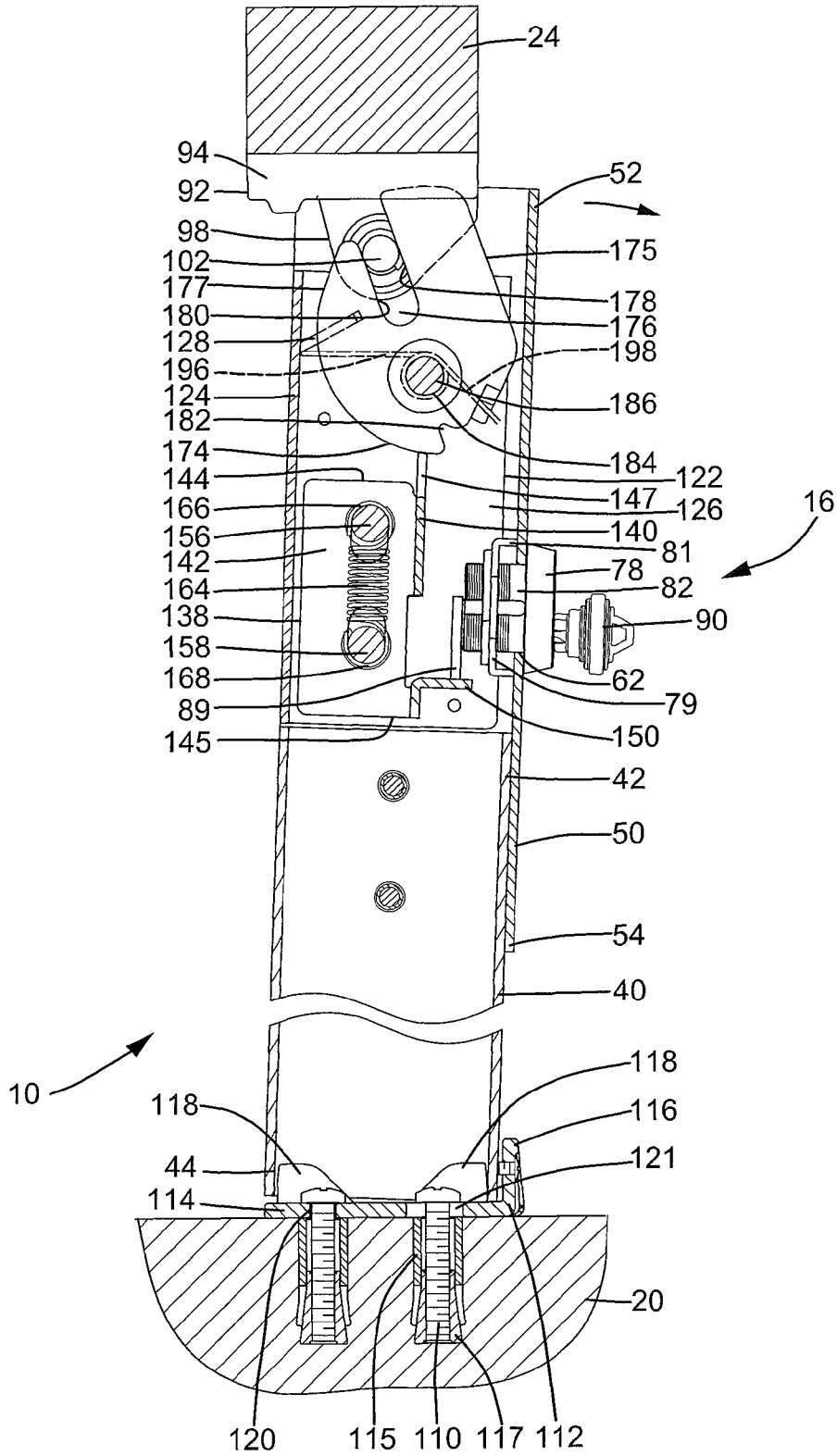
FIG. 10 shows a cross sectional view taken along section line 8-8 of FIG. 1 and similar to FIG. 9, with the post of the mullion assembly rotated in a direction away from the top mounting block.
Figure 11:
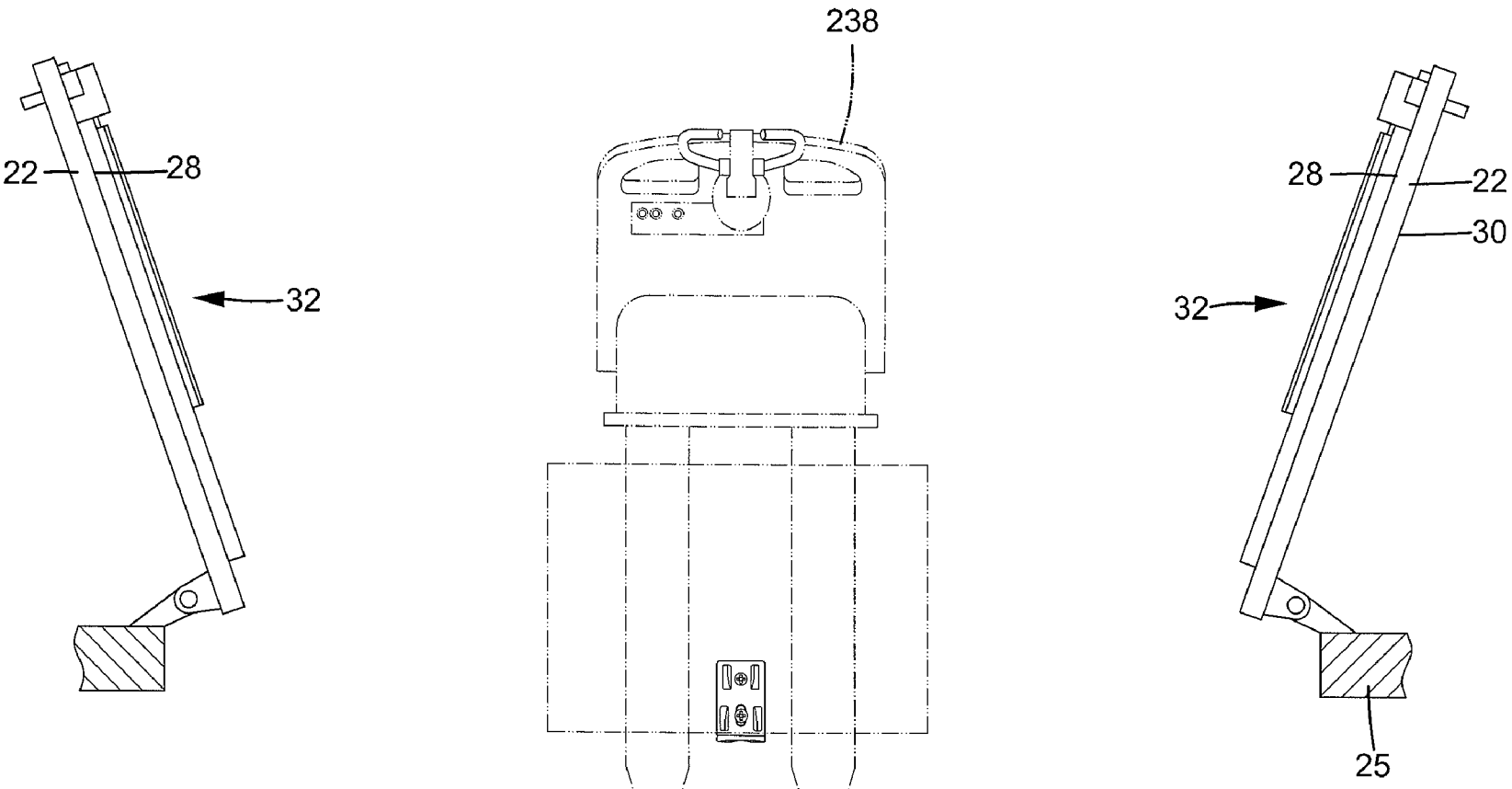
FIG. 11 shows a top view similar to FIG. 2, with two doors of the double door opened and with the post removed from top and bottom mounting blocks.

Mullion assembly 10 according to the preferred teachings of the present invention allows easy removal of post 40 from top and bottom mounting blocks 92 and 112. Namely, post 40 can be easily removed from top and bottom mounting blocks 92 and 112 by operating key cylinder 16. Specifically, when retaining member 138 in the locking position and when key 90 is inserted into keyway 88 of lock core 86 and rotated (see FIG. 9), actuating member 89 is rotated to actuate abutting portion 150 of retaining member 138 so that locking portion 147 of retaining member 138 is moved downward from the locking position to the unlocking position disengaged from notches 182 of pivotal plates 172, allowing removal of post 40 from top and bottom mounting blocks 92 and 112. More specifically, when retaining member 138 is moved by actuating member 89 from the locking position to the unlocking position, pivotal plates 172 can be moved from the first position to the second position so that post 40 can be rotated in a reverse direction (see FIG. 10). When post 40 is rotated in the reverse direction, ends 106 of positioning rod 102 presses against second side 180 of coupling slot 176 to move pivotal plates 172 from the first position to the second position, allowing removal of positioning rod 102 from coupling slots 176 of pivotal plates 172 and allowing disengagement of post 40 from top and bottom mounting blocks 92 and 112. Referring to FIG. 11, after mullion assembly 10 is removed and doors 26 are opened, a full door opening is provided, allowing unobstructed pass for a pushcart 238.

Figure 12:
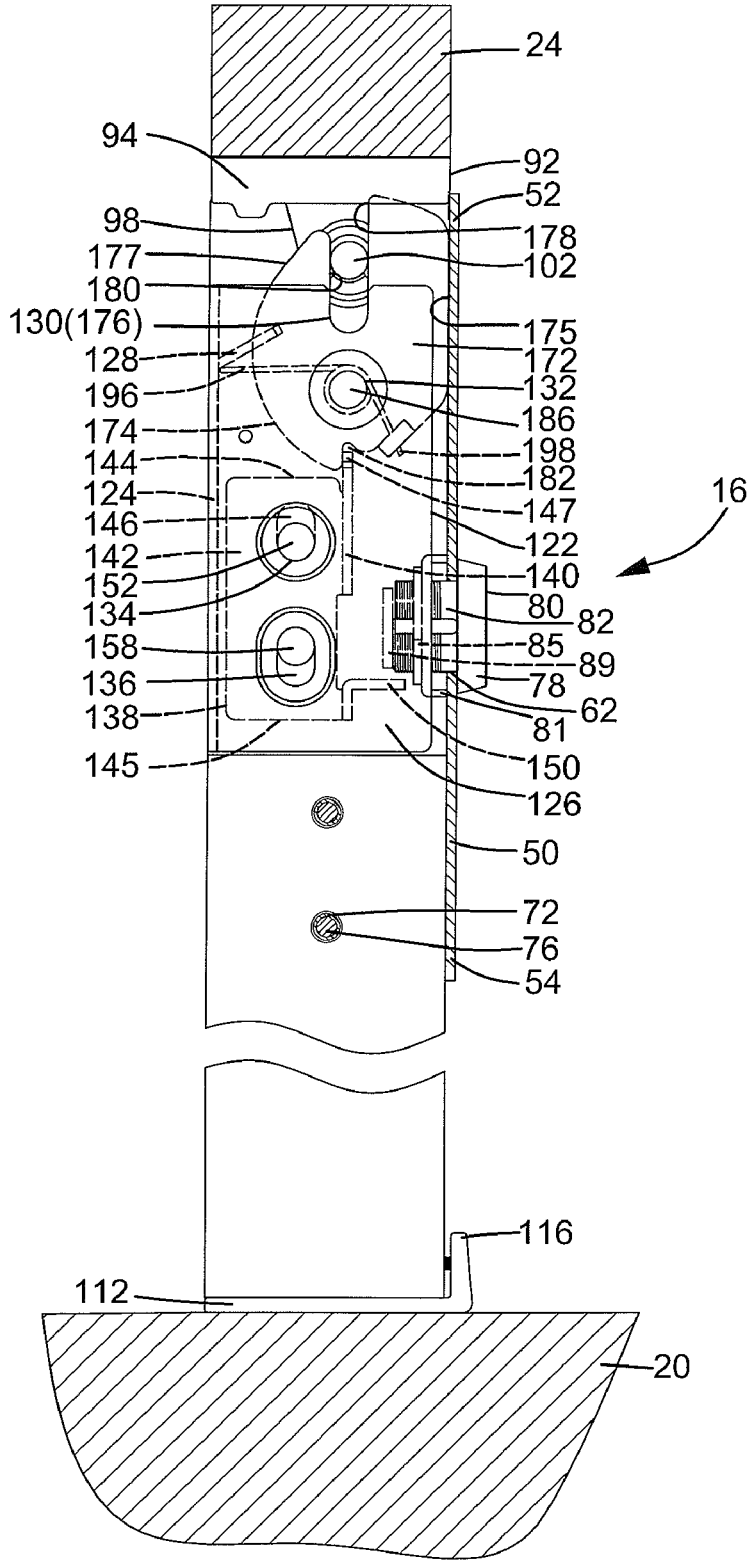
FIG. 12 is a cross sectional view taken along section line 8-8 of FIG. 1 and similar to FIG. 8 with an upper end of a mounting bracket aligned with and below a positioning rod of the top mounting block in a vertical direction.
Figure 13:
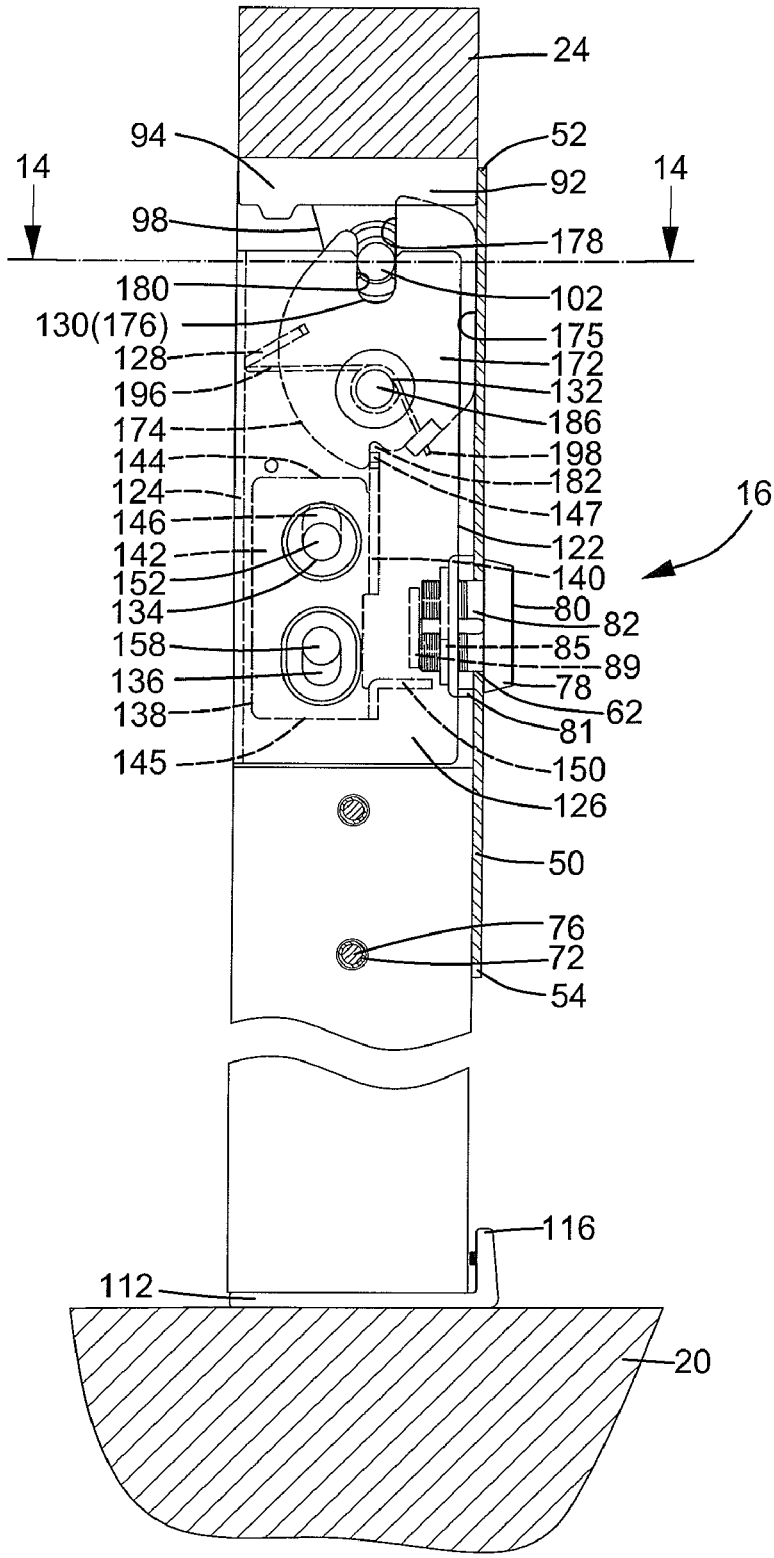
FIG. 13 shows a cross sectional view taken along section line 8-8 of FIG. 1 and similar to FIG. 12 with the upper end of the mounting bracket engaged with the positioning rod of the top mounting block.

Further, mullion assembly 10 according to the preferred teachings of the present invention provides an improved structural strength and fire resistant functions. Specifically, upper ends 123 of sidewalls 126 of mounting bracket 122 are aligned with and below positioning rod 102 of top mounting block 92 in the vertical direction when mounting bracket 122 in normal situations (see FIG. 12). The engaging force between post 40 and top and bottom mounting blocks 92 and 112 depends on positioning rod 102 received in coupling slots 176 of pivotal plates 172. On the other hand, when the mullion assembly 10 is exposed to a fire, post 40 will be heated by high temperature and move upwardly in the vertical direction due to thermal expansion. Thus, mounting bracket 122 moves upwardly in the vertical direction due to thermal expansion of post 40 (see FIGS. 13 and 14) so that coupling openings 130 of mounting bracket 122 are coupled with ends 106 of positioning rod 102 of top mounting block 92. The engaging force between post 40 and top and bottom mounting blocks 92 and 112 is increased by engagement of mounting bracket 122 with positioning rod 102 and is, thus, sufficient to withstand high pressure gas that may occur due to explosion or high temperature of combustion in the fire, preventing doors 26 from undesired opening. Improved structural strength and fire resistant functions are, thus, provided.

Now that the basic teachings of the present invention have been explained, many extensions and variations will be obvious to one having ordinary skill in the art. For example, first end 166 of spring 164 can be attached to mounting bracket 12 and second end 168 of spring 164 can be attached second limiting pin 158 to bias retaining member 138 toward pivotal plates 172, so that mounting bracket 12 does not have to include first limiting pin 152.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A mullion assembly for a double door comprising, in combination:

a top mounting block adapted to be attached to a top beam of a door frame for a double door including first and second doors, with the door frame including two opposite side beams to which the first and second doors are pivotably mounted, with each of the first and second doors including a door lock having a latch, with the top mounting block including a positioning rod extending in a horizontal direction;

a bottom mounting block adapted to be mounted on a floor spaced from the top beam in a vertical direction perpendicular to the horizontal direction, with the bottom mounting block aligned with the top mounting block in the vertical direction;

a post including upper and lower ends spaced in the vertical direction, with the lower end of the post detachably engaged with the bottom mounting block, with the post further including two strikes adapted to respectively couple with the latches of the door locks when the first and second doors are in a closed state;

a brace mounted to the upper end of the post;

a mounting bracket mounted to the brace;

a first pivotal plate pivotably mounted to the mounting bracket and including upper and lower ends spaced in the vertical direction, with the first pivotal plate further including a first coupling slot in the upper end of the first pivotal plate, with the positioning rod removably received in the first coupling slot of the first pivotal plate, with the upper end of the first pivotal plate being rotatable relative to the mounting bracket between a first position and a second position;

a retaining member moveably mounted to the mounting bracket and including a locking portion and an engaging portion, with the locking portion of the retaining member being moveable between a locking position engaged with the first pivotal plate and an unlocking position disengaged from the first pivotal plate;

a key cylinder mounted to the brace and including a key-operable actuating member, with the actuating member being operably connected to the engaging portion of the retaining member to move the retaining member between the locking position and the unlocking position, wherein when the upper end of the first pivotal plate is in the first position and the locking portion of the retaining member is in the locking position, the first pivotal plate can not be rotated relative to the mounting bracket from the first position to the second position, locking the post between the top and bottom mounting blocks, and wherein when the upper end of the first pivotal plate is in the first position and the locking portion of the retaining member is in the unlocking position, the first pivotal plate can be rotated relative to the mounting bracket from the first position to the second position, allowing removal of the post from the top and bottom mounting blocks.

2. The mullion assembly as claimed in claim 1, with the mounting bracket being substantially U-shaped in cross section and including a main wall and two sidewalls interconnected by the main wall, with the two sidewalls of the mounting bracket spaced in the horizontal direction and each including upper and lower ends spaced in the vertical direction, with the upper end of each of the two sidewalls having a coupling opening aligned with and below the positioning rod of the top mounting block in the vertical direction, and with the coupling openings of the mounting bracket coupled with the positioning rod of the top mounting block when the mounting bracket moves upwardly in the vertical direction due to thermal expansion of the post.

3. The mullion assembly as claimed in claim 2, with the two sidewalls of the mounting bracket further including aligned shaft holes, with the first pivotal plate further including an engaging hole aligned with the shaft holes of the mounting bracket, with a shaft extending through the shaft holes of the mounting bracket and the engaging hole of the first pivotal plate to allow the first pivotal plate to rotate about a pivot axis defined by the shaft between the first position and the second position.

4. The mullion assembly as claimed in claim 3, with the two sidewalls of the mounting bracket further including aligned sliding slots, with the two sidewalls of the mounting bracket further including aligned limiting holes each intermediate one of shaft holes and one of sliding slots in the vertical direction, with the retaining member being substantially U-shaped in cross section and including an interconnecting plate and two side plates interconnected by the interconnecting plate and spaced in the horizontal direction, with interconnecting plate further including upper and lower ends spaced in the vertical direction, with the locking portion of the retaining member formed on the upper end of the interconnecting plate, with the engaging portion of retaining member extending from the lower end of the interconnecting plate away from the two side plates of the retaining member in a width direction perpendicular to the horizontal and vertical directions, with the two side plates of the retaining member including aligned limiting slots aligned with the limiting holes of the mounting bracket, with a first limiting pin extending through the limiting holes of the mounting bracket and the limiting slots of the retaining member, with the two side plates of the retaining member further including aligned positioning holes aligned with the sliding slots of the mounting bracket, with a second limiting pin extending through the sliding slots of the mounting bracket and the positioning holes of the retaining member to allow the retaining member to move between the locking position and the unlocking position in the vertical direction, with the first limiting pin located between the shaft and the second limiting pin, with the retaining member further including a spring having a first end attached to the first limiting pin and a second end attached to the second limiting pin to bias the retaining member toward the first pivotal plate.

5. The mullion assembly as claimed in claim 4, further comprising, in combination:

a second pivotal plate pivotably mounted to the mounting bracket and spaced from the first pivotal plate in the horizontal direction, with the second pivotal plate including upper and lower ends spaced in the vertical direction, with the second pivotal plate further including a second coupling slot in the upper end of the second pivotal plate, with the positioning rod removably received in the second coupling slot of the second pivotal plate, with the second pivotal plate further including an engaging hole aligned with the shaft holes of the mounting bracket, with the shaft extending through the engaging hole of the second pivotal plate to allow the second pivotal plate to rotate about the pivot axis between the first position and the second position; and a torsion spring mounted between the first and second pivotal plates and biasing the first and second pivotal plates from the first position to the second position, with each of the first and second pivotal plates abutting the main wall of the mounting bracket when the first and second pivotal plates are in the second position, with each of the first and second coupling slots of the first and second pivotal plates being at an acute angle to the vertical direction when the first and second pivotal plates are in the second position, and with the first and second coupling slots of the first and second pivotal plates substantially extending in the vertical direction when the first and second pivotal plates are in the first position.

6. The mullion assembly as claimed in claim 5, with the brace being substantially U-shaped in cross section and including a first wall and second and third walls interconnected by the first wall, with the second and third walls spaced in the horizontal direction, with the brace further including upper and lower portions spaced in the vertical direction, with the lower portion of the brace fixed to the upper end of the post, with the key cylinder mounted on the first wall of the brace, and with each of the first and second pivotal plates abutting against the first wall of the brace when the first and second pivotal plates are in the first position.

7. The mullion assembly as claimed in claim 6, with the top mounting block including top and bottom portions spaced in the vertical direction, with the bottom portion of the top mounting block including a rod hole extending through the bottom portion in the horizontal direction, with the positioning rod extending through the rod hole, with the positioning rod including two ends spaced in the horizontal direction and located outside of the rod hole, with the positioning rod further including an intermediate section intermediate the two ends of the positioning rod and received in the rod hole, with the two ends of the positioning rod removably received in the first and second coupling slot of the first and second pivotal plates, and with the coupling openings of the mounting bracket coupled with the two ends of the positioning rod of the top mounting block when the mounting bracket moves upwardly in the vertical direction due to thermal expansion of the post.

8. The mullion assembly as claimed in claim 7, with each of the first and second pivotal plates further including a notch adjacent to the lower end of the first and second pivotal plates, with the locking portion of the retaining member being moveable in the vertical direction between the locking position engaged with the notches of the first and second pivotal plates and the unlocking position disengaged from the notches of the first and second pivotal plates.

9. The mullion assembly as claimed in claim 8, with the positioning rod further including two annular grooves respectively intermediate the two ends and the intermediate section of the positioning rod, with a retainer ring mounted in each of the annular grooves to retain the positioning rod in the rod hole of the top mounting block.

10. The mullion assembly as claimed in claim 9, with the bottom mounting block including a base having first and second sides spaced in a width direction perpendicular to the horizontal and vertical directions, with a vertical wall extending upward from the first side of the base in the vertical direction, with two spaced first coupling portions extending upward from the second side of the base in the vertical direction, with two spaced second coupling portions extending upward in the vertical direction and between the first coupling portions and the vertical wall in the width direction, with the lower ends of the post engaged around the first and second coupling portions of the bottom mounting block and resting on the base, with a portion of the lower ends of the post is fixed between the second coupling portions and the vertical wall of the bottom mounting block.

* * * * *